US008246779B2

(12) United States Patent
Foan et al.

(10) Patent No.: US 8,246,779 B2
(45) Date of Patent: Aug. 21, 2012

(54) MAINTENANCE OF SULFUR CONCENTRATION IN KRAFT PULP PROCESSES

(75) Inventors: Jonathan Edward Foan, Vancouver (CA); James Theodore Wearing, Vancouver (CA)

(73) Assignee: NORAM Engineering and Constructors Ltd., Vancouver (CA)

( * ) Notice: Subject to any disclaimer, the term of this patent is extended or adjusted under 35 U.S.C. 154(b) by 49 days.

(21) Appl. No.: 12/890,228

(22) Filed: Sep. 24, 2010

(65) Prior Publication Data

US 2011/0067829 A1 Mar. 24, 2011

Related U.S. Application Data

(60) Provisional application No. 61/245,646, filed on Sep. 24, 2009.

(51) Int. Cl.
*D21C 11/12* (2006.01)
*D21C 11/00* (2006.01)

(52) U.S. Cl. ..... 162/30.11; 162/29; 162/30.1; 162/31; 162/DIG. 8

(58) Field of Classification Search ..... 162/29, 162/30.1, 30.11, 31, DIG. 8, DIG. 9
See application file for complete search history.

(56) References Cited

U.S. PATENT DOCUMENTS 3,366,534 A * 1/1968 Rapson ..... 162/30.11
3,442,778 A * 5/1969 Westerlund ..... 423/180
3,684,672 A * 8/1972 Iwahashi et al. ..... 205/622
3,833,462 A 9/1974 Moy et al.
4,007,082 A * 2/1977 Fuller ..... 162/30.11
4,039,372 A * 8/1977 Reeve et al. ..... 162/19
5,300,191 A * 4/1994 Lindberg ..... 162/31
5,340,440 A * 8/1994 Henricson ..... 162/31
5,366,593 A * 11/1994 Lee et al. ..... 162/72
5,374,333 A * 12/1994 Nykanen et al. ..... 162/31
5,567,293 A * 10/1996 Paleologou et al. ..... 204/523
5,674,466 A 10/1997 Dahl et al.
5,792,441 A 8/1998 Paleologou et al.
5,911,854 A * 6/1999 Lindman ..... 162/29
(Continued)

FOREIGN PATENT DOCUMENTS

WO WO 9600322 A1 * 1/1996

OTHER PUBLICATIONS

Brown, C.J. et al., "Ion-Exchange Technologies for the Minimum Effluent Kraft Mill", Presented at the CPPA Technical Section Symposium on System Closure II, Montreal, Jan. 26-30, 1998.

*Primary Examiner* — Jose A Fortuna
(74) *Attorney, Agent, or Firm* — Oyen Wiggs Green & Mutala LLP

(57) ABSTRACT

Methods and apparatus for maintaining sulfur concentration in the chemical recovery cycle of a Kraft pulping process. A portion of the recovery boiler ash is dissolved, treated to remove solids, and combined with an acid to provide a solution. The recovery boiler ash may be dissolved directly in the acid. The acid may be effluent from a chlorine dioxide generator. The resulting solution is maintained in a fully dissolved state and subjected to an acid separation step to provide a sodium sulfate enriched phase, which may be used to maintain sulfur concentration in the Kraft pulping process, and a sulfuric acid phase. Chlorine ions can be separated with the sulfuric acid phase. The sulfuric acid phase can be recycled to the chlorine dioxide generator.

11 Claims, 8 Drawing Sheets

U.S. PATENT DOCUMENTS 5,922,171 A 7/1999 Paleologou et al.
5,938,892 A * 8/1999 Maples et al. ..... 162/30.1
5,961,803 A * 10/1999 Landfors et al. ..... 204/529
6,162,408 A * 12/2000 Wimby ..... 423/184
6,440,379 B1 * 8/2002 Verrill et al. ..... 423/243.01
6,585,880 B1 * 7/2003 Watanabe et al. ..... 205/494
8,088,199 B2 * 1/2012 Olsen et al. ..... 95/107
2010/0041879 A1 * 2/2010 Stigsson et al. ..... 536/127
2011/0067829 A1 * 3/2011 Foan et al. ..... 162/29

* cited by examiner

MAINTENANCE OF SULFUR CONCENTRATION IN KRAFT PULP PROCESSES

REFERENCE TO RELATED APPLICATION

This application claims the benefit under 35 U.S.C. §119 of U.S. Application No. 61/245,646 filed 24 Sep. 2009 and entitled MAINTENANCE OF SULFUR CONCENTRATION IN KRAFT PULP PROCESSES, the entirety of which is hereby incorporated by reference.

TECHNICAL FIELD

This invention relates generally to the Kraft process for the production of bleached cellulosic fibrous pulp. The invention is concerned more particularly with an improvement by which sulfur concentration can be maintained in the Kraft pulp mill chemical recovery cycle.

BACKGROUND

The chemicals used for pulping of wood in a Kraft pulp mill are recovered in the Kraft pulp mill chemical recovery cycle. Various losses of chemicals exist throughout the cycle, so makeup chemicals are required. One common source of chemical makeup for mills that generate chlorine dioxide onsite for use in the pulp bleaching process is the effluent from the chlorine dioxide generator.

With reference to FIG. 1, in a typical Kraft pulp mill 20, wood in the form of chips or sawdust is cooked in a digester 22 with a combination of pulping chemicals known as white liquor to dissolve hemicellulose, lignin, and other extractable materials. White liquor consists primarily of sodium sulfide ($Na_2S$), sodium hydroxide (NaOH), sodium carbonate ($Na_2CO_3$), and impurities. The digester products, which include cellulosic fibres, dissolved hemicellulose, lignin and extractables, and spent pulping chemicals are separated by filtration in brown stock washer 24. The cellulosic fibres from the wood are retained on the filter, and further processed to pulp. The dissolved hemicellulose, lignin and extractables, and spent pulping chemicals, known as black liquor, are recovered in the Kraft pulp mill chemical recovery cycle.

The first step in the Kraft pulp mill chemical recovery cycle is evaporation in evaporators 26, where black liquor is concentrated by a multi stage evaporation and concentration process. The concentrated black liquor is then burned in a recovery boiler 28. The recovery boiler 28 has two purposes: generating steam for the pulping process, and converting spent chemicals to useful pulping chemicals. The spent chemicals are recovered by dissolving the smelt from the recovery boiler 28 in water in dissolving tank 30 to form green liquor, a solution consisting of mostly dissolved $Na_2S$ and $Na_2CO_3$.

The green liquor is first treated by clarification or filtration in a green liquor clarifier 32 to remove solids known as dregs. Clarified green liquor is sent to the recausticizing plant 34. In recausticizing, the $Na_2CO_3$ in the green liquor is reacted with calcium oxide (CaO) in a causticizing reaction where it is converted to NaOH to form white liquor slurry. The calcium oxide is converted in the reaction to calcium carbonate ($CaCO_3$), which is separated from the white liquor slurry by clarification or filtration in a white liquor clarifier 36, and subsequently burned in a lime kiln 38 to reform calcium oxide.

The clarified or filtered white liquor slurry, known as white liquor, is reused as pulping chemical in the digester 22.

One major source of sulfur losses from the Kraft pulp mill chemical recovery cycle is the electrostatic precipitator (ESP) catch purge. The electrostatic precipitator 40 is used to capture and return solids carried over from the recovery boiler, and a portion of the solids are purged to remove chloride, an impurity, from the chemical recovery cycle. Other chemical losses occur through recovery boiler and lime kiln emissions, liquor lost while removing grits, and knots, liquor spills, sewers in the recausticizing plant, white liquor used in bleach plant scrubber, and $SO_2$ emissions from various sources. (Blackwell and Lincoln, P&P Canada 99:1 1998). These lost chemicals need to be replaced (made up) to maintain the strength of the white liquor used in the digesters.

Several prior art processes have taken advantage of the enrichment of chloride in the electrostatic precipitator catch to facilitate removal of chloride impurities from the chemical recovery cycle by treating the precipitator catch to separate chloride from $Na_2SO_4$ and $Na_2CO_3$ (see, for example, U.S. Pat. No. 5,922,171). One process described in U.S. Pat. No. 3,833,462 leaches the precipitator catch with sufficient aqueous sulfuric acid solution (which may be spent sulfuric acid from a chlorine dioxide generator) to produce a leached slurry of pH 3-6, thereby converting sodium carbonate to sodium sulfate. The leached solution is filtered to give a cake of anhydrous sodium sulfate and a filtrate enriched in sodium chloride.

One major source of makeup to the chemical recovery cycle is chlorine dioxide generator effluent, which contains sodium sulfate and sulfuric acid. Kraft pulp mills typically include a chlorine dioxide generator 42 to provide chlorine dioxide to a bleach plant 44 if the pulp is to be bleached. The chlorine dioxide generator effluent may be in the form of the acidic salt sodium sesquisulfate. The generator effluent may be used to make up lost sulfur. Some sodium is also recovered with the generator effluent, but the sodium to sulfur (Na:S) ratio is lower than that required in white liquor, so another source of sodium is required. Extra sodium is often made up with caustic soda (NaOH). Acid separation systems to separate sulfuric acid from sodium sulfate are commercially available. The use of these systems results in a higher Na:S ratio in the chemical makeup and reduces the amount of caustic soda which needs to be purchased. The separated sulfuric acid can be used in many places in a Kraft pulp mill, for example in acidification of bleach plant chlorine dioxide stages.

In specific cases where sulfur losses from the Kraft pulp mill chemical recovery cycle are high, separating sulfuric acid for reuse in other areas of the mill results in an excessive loss of sulfur, resulting in the need to purchase additional sulfur chemicals as makeup.

SUMMARY

The inventors have determined that adding a portion of dissolved, treated, recovery boiler ash to the waste acid from a chlorine dioxide generator, then treating the combined liquids in an acid separation step while maintaining sodium sulfate in a dissolved phase can maintain sulfur concentration in the Kraft pulp mill chemical recovery cycle without increasing the chloride ion concentration.

One embodiment provides processes involving maintaining the sulfur concentration in the chemical recovery cycle of a Kraft pulping process. An example process may comprise the steps of:

(a) collecting recovery boiler ash from a recovery boiler of a Kraft pulp mill;

(b) dissolving a portion of the recovery boiler ash in acid;

(c) treating the dissolved recovery boiler ash-acid solution to remove solids;

(d) subjecting the treated solution to an acid separation step to provide a sodium sulfate enriched phase and an acid phase; and (e) using at least a portion of the sodium sulfate enriched phase to maintain sulfur concentration in the Kraft pulping process.

In another example embodiment, a process for maintaining the sulfur concentration in the chemical recovery cycle of a Kraft pulping process may comprise the steps of:

(a) collecting recovery boiler ash from a recovery boiler of a Kraft pulp mill;

(b) dissolving a portion of the recovery boiler ash;

(c) treating the dissolved recovery boiler ash to remove solids;

(d) combining the treated dissolved recovery boiler ash with acid to provide a solution;

(e) maintaining the solution in a fully dissolved state;

(f) subjecting the solution to an acid separation step to provide a sodium sulfate enriched phase and an acid phase; and (g) using at least a portion of the sodium sulfate enriched phase to maintain sulfur concentration in the Kraft pulping process.

In some embodiments, the acid used in the process may be effluent from a chlorine dioxide generator of the Kraft pulp mill.

Other aspects of the invention provide Kraft pulp apparatus for maintaining sulfur concentration in a Kraft pulp mill. In one example embodiment, the apparatus has a separator to capture recovery boiler ash from the exhaust of a recovery boiler of the Kraft pulp mill; a dissolving tank for receiving and dissolving the recovery boiler ash in acid; a solids separation unit for treating the dissolved recovery boiler ash to remove solids and provide a fully dissolved recovery boiler ash-acid solution; and an acid separation unit in fluid communication with the solids separation unit.

In another example embodiment, the apparatus has a separator to capture recovery boiler ash from the exhaust of a recovery boiler of the Kraft pulp mill, a dissolving tank for receiving and dissolving the recovery boiler ash, a solids separation unit for treating the dissolved recovery boiler ash to remove solids and provide a fully dissolved solution, a mixing point for mixing the clarified solution with acid while maintaining the resulting solution in a fully dissolved state, and an acid separation unit in fluid communication with a mixing point.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in the accompanying drawings. The drawings are illustrative and not restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

In accordance with an embodiment of the invention, sulfur concentration is maintained in the chemical recovery cycle of a Kraft pulping process by combining a portion of the recovery boiler ash with acid, which may be effluent from a chlorine dioxide generator of the Kraft pulp mill. The combined recovery boiler ash and acid are maintained in a fully dissolved state and are treated in an acid separation system prior to returning the sodium sulfate solution so obtained to the Kraft pulp mill cycle to maintain sulfur concentration in the Kraft pulping process.

As used herein, the term "fully dissolved" means that a solution does not contain appreciable amounts of precipitate that would interfere with use of a fixed-resin bed acid retardation unit to perform an acid separation step, as described below.

Figure 1:
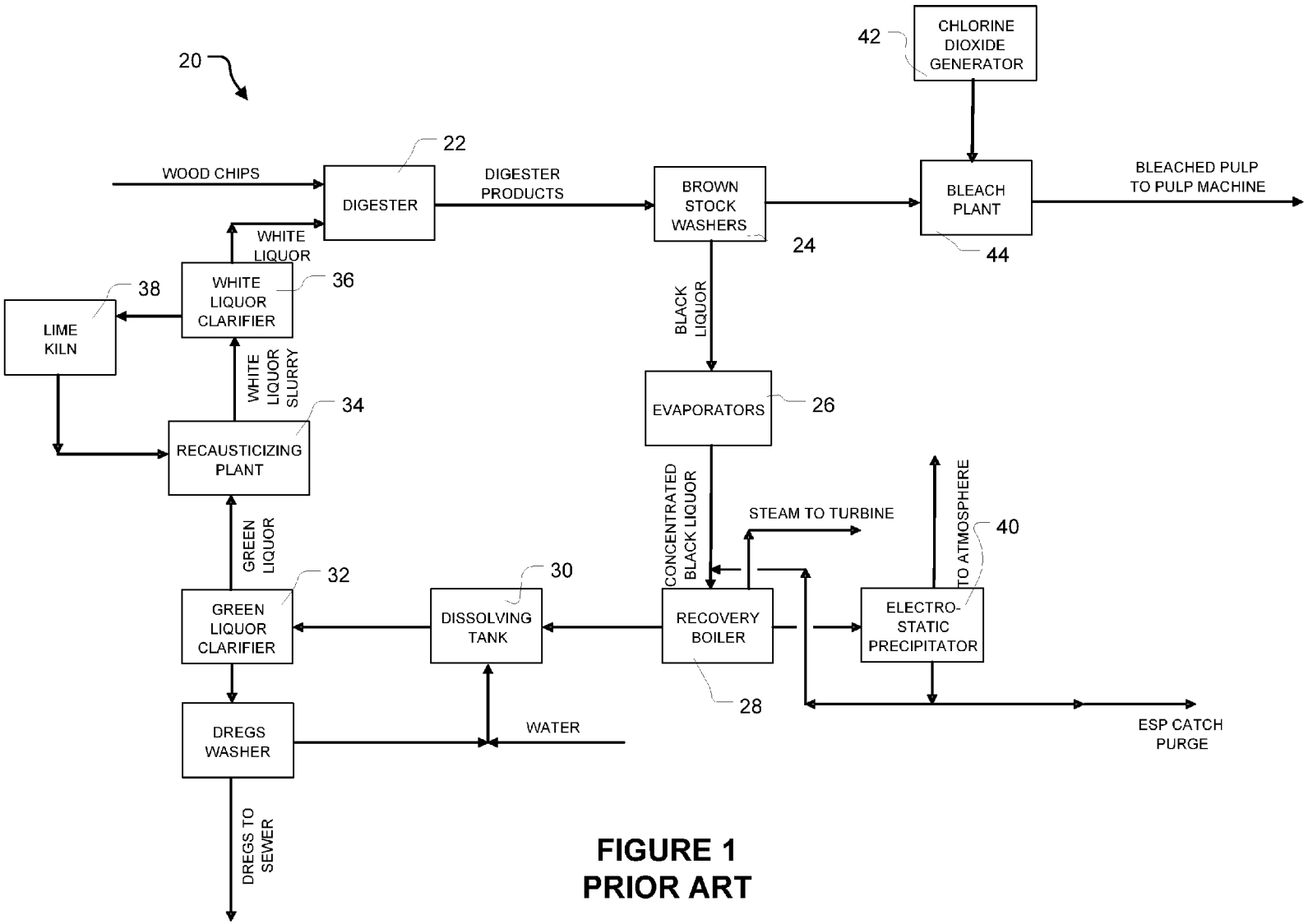
FIGURE 1 PRIOR ART
FIG. 1 is a block diagram of a typical Kraft pulp mill.
Figure 2:
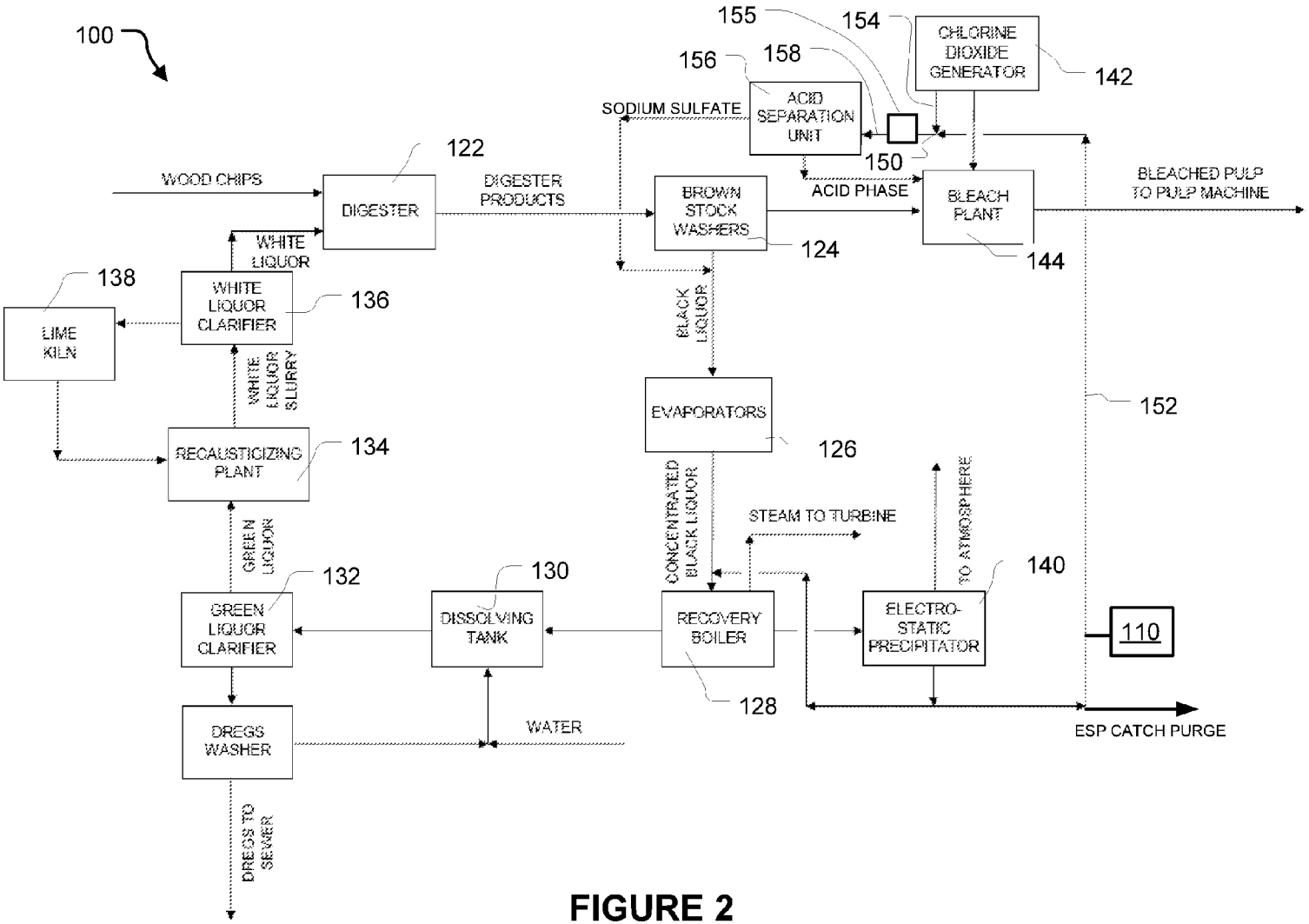
FIG. 2 is a block diagram of a Kraft pulp mill according to an example embodiment of the invention.

FIG. 2 shows a Kraft mill 100 according to an example embodiment of the invention. Components of FIG. 2 which perform a similar function to those previously described with reference to FIG. 1 are shown with reference numerals incremented by 100. These include the digester 122, brown stock washers 124, evaporators 126, dissolving tank 130, green liquor clarifier 132, recausticizing plant 134, white liquor clarifier 136, lime kiln 138, chlorine dioxide generator 142, and bleach plant 144. Kraft pulp mill 100 functions generally similarly to pulp mill 20 to produce pulp.

In the illustrated embodiment, an electrostatic precipitator 140 (which could be any other suitable separator) captures solids in the form of recovery boiler ash from the exhaust of recovery boiler 128. The resulting recovery boiler ash, in the form of ESP catch purge in the illustrated embodiment, is provided to a mixing point 150 via conduit 152. Effluent from chlorine dioxide generator 142 is also introduced to mixing point 150 via conduit 154 so that the recovery boiler ash is dissolved in the chlorine dioxide generator effluent. The amount of recovery boiler ash added is limited so that sodium sulfate is maintained in a fully dissolved state, for example so that the maximum concentration of sodium sulfate is about 40 g per 100 g of water. In some embodiments, the concentration of sodium sulfate may be maintained at a concentration approaching saturation. The dissolved recovery boiler ash-chlorine dioxide generator effluent is then treated to remove solids in a solids separation unit 155, which may be, for example, a surface filtration unit, a cross flow filtration unit, or a settling tank. The treated solution is passed to acid separation unit 156 via conduit 158, where the solution is separated into a sodium sulfate rich phase, which may be used to maintain the concentration of sulfur in the Kraft pulping process, and an acid rich phase including chloride ions, which may be used in any desired manner. The acid rich phase may be recycled to the chlorine dioxide generator.

In the embodiment illustrated as Kraft mill 200 in FIG. 3, wherein reference numerals referring to components with the same functions as those described with reference to FIG. 1 have been incremented by 200, an electrostatic precipitator 240 collects recovery boiler ash from recovery boiler 228. The effluent from the chlorine dioxide generator 242 is fed directly to a dissolving tank 270 via conduit 272 so that the recovery boiler ash is dissolved directly in the chlorine dioxide generator effluent. The amount of recovery boiler ash added is limited so that sodium sulfate is maintained in a fully dissolved state, for example so that the maximum concentration of sodium sulfate is about 40 g per 100 g of water. In some embodiments, the concentration of sodium sulfate may be maintained at a concentration approaching saturation.

The combined recovery boiler ash-chlorine dioxide generator effluent solution is then fed via conduit 274 to a solids removal device 276, which may be, for example, a surface filtration unit, a cross flow filtration unit, a settling tank, or any other suitable solids separation mechanism. The clarified recovery boiler ash-chlorine dioxide generator effluent solution is then fed to acid separation unit 256, where the solution is separated into a sodium sulfate rich phase that can be fed back into the Kraft pulping process to maintain sulfur concentration, and an acid rich phase including chloride ions. The acid rich phase may be recycled in any desired manner. For example, the acid rich phase may be recycled for use in chlorine dioxide generator 242.

In an alternative embodiment illustrated as Kraft mill 300 in FIG. 4, wherein reference numerals referring to components with the same functions as those described with reference to FIG. 3 have been incremented by 100, the recovery boiler ash may be initially dissolved in a suitable solvent such as water in dissolving tank 370. The amount of recovery boiler ash added is limited so that sodium sulfate is maintained in a fully dissolved state, for example so that the maximum concentration of sodium sulfate is about 40 g per 100 g of water. In some embodiments, the concentration of sodium sulfate may be maintained at a concentration approaching saturation. The resulting solution is then passed via a conduit 374 to solids removal unit 376, which may be, for example, a surface filtration unit, a cross flow filtration unit, a settling tank, or any other suitable solids separation mechanism. The clarified recovery boiler ash solution is then passed via conduit 391 to a mixing point 390, where it is combined with chlorine dioxide generator effluent delivered through conduit 392. The combined recovery boiler ash-chlorine dioxide generator effluent solution is maintained in a fully dissolved state and passed to acid separation unit 356 via conduit 394.

In embodiments in which recovery boiler ash is not combined with chlorine dioxide generator effluent, or where it is desired to add further acid, an acid such as sulfuric acid or aqueous sodium sesquisulfate may alternatively or additionally be used in dissolving tank 270 or dissolving tank 370, or may be introduced at mixing point 150 or mixing point 390, or in any suitable manner.

In some embodiments, a controller 110 may be provided to regulate the rate of addition of recovery boiler ash to solvent to maintain the amount of sulfur in the mill's chemical recovery cycle. Controller 110 may operate by regulating the volume or weight of recovery boiler ash fed to dissolving tank 270 or 370, or to mixing point 150 or mixing point 390. The amount of recovery boiler ash to be added by controller 110 may be determined based on the amount of sulfur in the mill's chemical recovery cycle (i.e. the sulfidity of the Kraft pulp mill). The sulfidity of the Kraft pulp mill may be determined for example by titration with an acid according to standard industry methods. The desired level of sulfidity in a particular Kraft pulp mill may be determined by one skilled in the art, and may be for example in the range of 25% to 30%, as measured by the ratio of sulfur containing sodium compounds to total sodium compounds or active sodium compounds. Excess recovery boiler ash may be sewered or disposed of in any appropriate manner.

Figure 3:
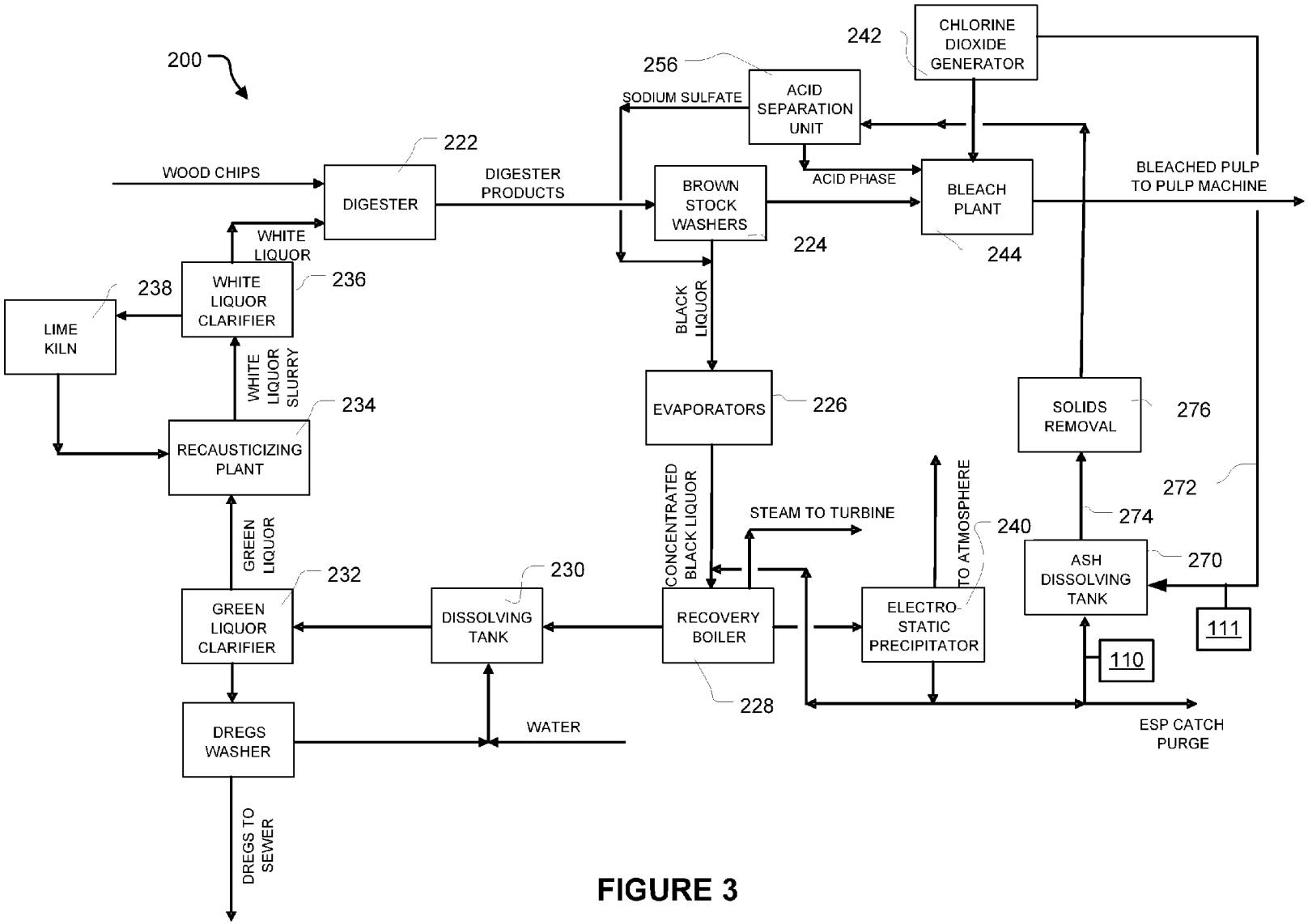
FIG. 3 is a block diagram of a Kraft pulp mill according to an alternative embodiment of the invention.
Figure 4:
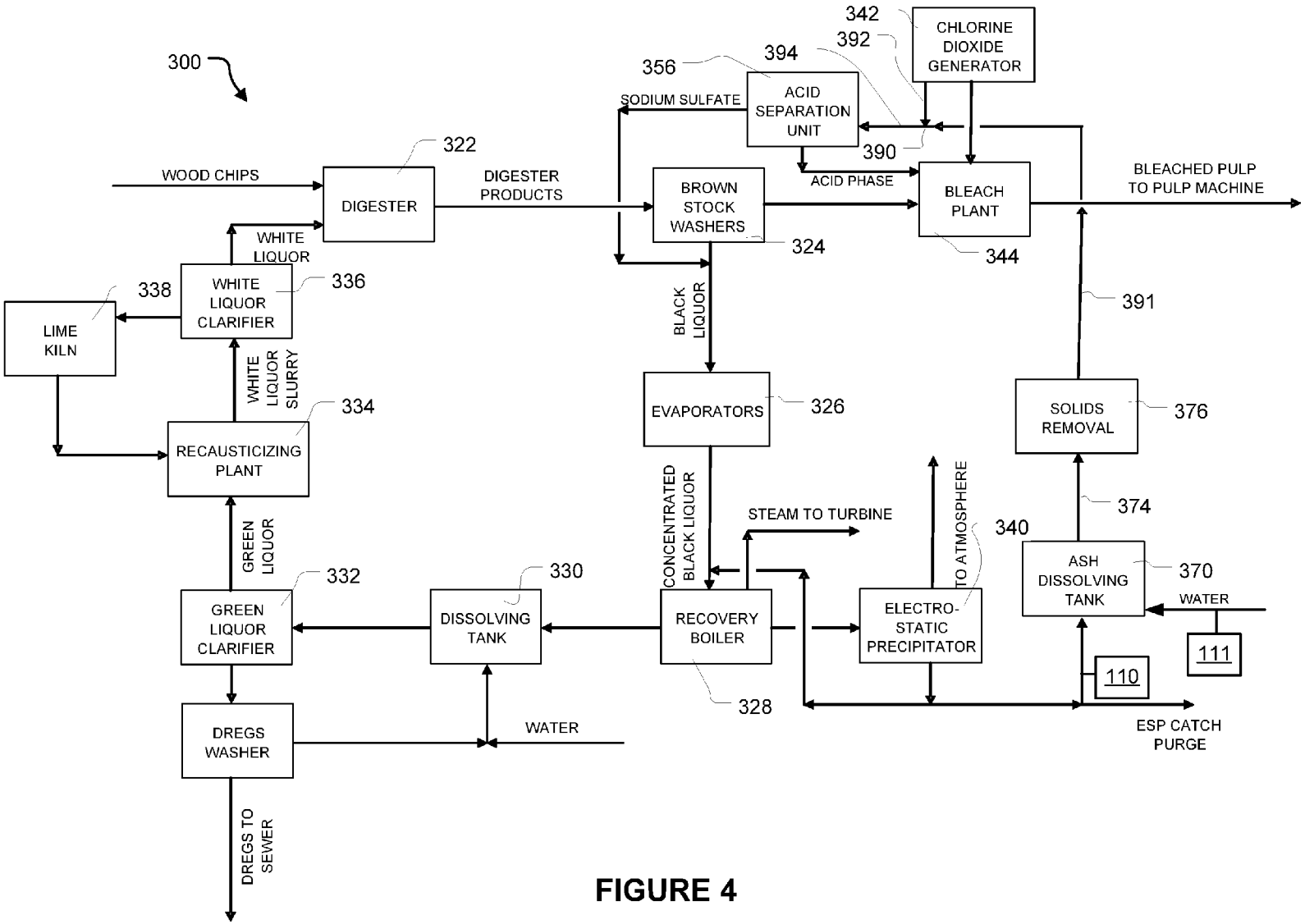
FIG. 4 is a block diagram of a Kraft pulp mill according to an alternative embodiment of the invention.

As illustrated in FIGS. 3 and 4, in some embodiments, a controller 111 may be provided to regulate the rate or amount of solvent addition to maintain the sodium sulfate in a fully dissolved state, for example at a concentration of less than about 40 g per 100 g of water. Controller 111 may also be configured to maintain a concentration of sodium sulphate approaching saturation. Controller 111 may regulate the rate or amount of solvent provided to dissolving tank 370 in response to characteristics of the solution within dissolving tank 370, such as its conductivity or density. Controller 111 may regulate solvent addition in response to feedback from instruments for measuring conductivity, density, or other properties indicative of the sodium sulfate concentration of the solution within dissolving tank 370, and/or of the solution entering or exiting dissolving tank 370. Controller 111 may regulate the amount of solvent provided to maintain the solution in tank 370 below the saturation point of sodium sulfate.

In some embodiments, the acid separation unit includes a fixed-resin bed retardation unit incorporating a particulate quaternary ammonium resin, for example as described in U.S. Pat. No. 5,792,441, the entirety of which is hereby incorporated by reference. In some embodiments, the combined flow of recovery boiler ash and chlorine dioxide generator effluent may be stored in a receiving tank and then applied to the column. The column is alternately fed with the combined boiler recovery ash-chlorine dioxide generator effluent to sorb the acid while allowing the sodium sulfate to pass through the column, and then washed with water to elute the acid phase, as described in U.S. Pat. No. 5,792,441. This provides a sodium sulfate enriched phase, which can be used to maintain sulfur concentration in the Kraft pulp mill, and an acid-enriched phase including chlorine ions that can be utilized in any desired manner, for example by being recycled back to the chlorine dioxide generator.

Methods for maintaining sulfur concentration in the Kraft pulp mill chemical recovery cycle are also provided. In one embodiment, recovery boiler ash from the recovery boiler of Kraft pulp mill is collected from the exhaust of the recovery boiler. In a typical Kraft pulp process, and as shown in the illustrated embodiments, an electrostatic precipitator will be used to collect solids in the form of recovery boiler ash, resulting in the production of an electrostatic precipitator (ESP) catch. It is not mandatory that an electrostatic precipitator be used to capture the recovery boiler ash. In the alternative, the solids carried over from the recovery boiler may be recovered by applying any suitable filter or scrubber to collect recovery boiler ash. Solids obtained by such other recovery methods are contemplated within the scope of embodiments of the invention.

At least a portion of the recovery boiler ash is dissolved in a suitable solvent, which may be water or acid. The acid may be effluent from the chlorine dioxide generator, or the acid may be sulfuric acid or sodium sesquisulfate. The amount of recovery boiler ash added to the acid is limited so that sodium sulfate is maintained in a fully dissolved state throughout the acid separation process. For example, where the acid separation step is conducted at a temperature of 30° C. or above, the concentration of sodium sulfate in the combined recovery boiler ash-acid solution may be maintained at or below about 40 g of sodium sulfate per 100 g of water. In some embodiments, the concentration of sodium sulfate may be maintained at a value approaching saturation. A controller may be provided to regulate the rate or volume of solvent addition to the recovery boiler ash based on a measure such as the density and/or conductivity of the resulting solution, to maintain the sodium sulfate in a fully dissolved state.

In some embodiments, the amount of recovery boiler ash added to the acid is regulated based on various inputs such as the concentration of sodium sulfate measured in the Kraft pulp mill chemical recovery cycle (i.e. the sulfidity of the Kraft pulping process). In some embodiments, the weight or volume of recovery boiler ash added in a given time may be regulated by a controller based on the sulfidity of the Kraft pulping process. Excess recovery boiler ash may be sewered or disposed of in any other acceptable manner.

The dissolved recovery boiler ash is treated in any suitable manner to remove solids, for example in a surface filtration unit, a cross flow filtration unit, or by settling. The treated solution is then provided to an acid separation system.

In embodiments in which the recovery boiler ash is not dissolved in the desired acid, the treated recovery boiler ash is combined with acid, either before or after solids are removed. Generally the acid used will be sulfuric acid or sodium sesquisulfate. The acid may be effluent from a chlorine dioxide generator of the Kraft pulp mill. Effluent from a chlorine dioxide generator contains sulfuric acid and sodium sulfate, which may be in the form of acidic sodium sesquisulfate. The solution may be treated to remove solids in any suitable manner, for example by surface filtration, cross flow filtration, or settling, prior to being passed to an acid separation system. Sodium sulfate is maintained in a fully dissolved state throughout the acid separation process.

The fully dissolved solution of recovery boiler ash combined with acid is then fed into an acid separation system to remove sulfuric acid. Acid separation is performed using a fixed bed of acid retardation resin. A strong base anion exchange resin incorporating a particulate quaternary ammonium resin may be used to perform the acid separation step, for example as described in U.S. Pat. No. 5,792,441, which is hereby incorporated by reference in its entirety. Acids are sorbed from solution by the resin, while salts of the acid are excluded. The acid can be desorbed from the resin with water. By alternately passing the dissolved and treated recovery boiler ash-acid solution through the bed of resin and washing the bed of resin with water, the acid may be separated from the sodium sulfate.

When appropriate conditions are used for the fixed bed of acid retardation resin, chlorine ions partition with the acid in the acid retardation resin (for example as described in U.S. Pat. No. 5,792,441). Chloride ions are eluted from the resin together with the sulfuric acid, i.e. in the acid phase. The resultant sulfuric acid product can be used for various purposes. For example, the sulfuric acid product may be recycled back to the chlorine dioxide generator after concentration through evaporation. The presence of chloride ions in the sulfuric acid product can be beneficial when used for this purpose.

The resulting de-acidified sodium sulfate phase contains a low level of chloride ions, and can be recycled back into the Kraft pulping process to maintain the sulfur concentration and reduce the make up requirements for sodium, without the need to remove chloride ions in a separate step.

EXAMPLES

The invention is further described with reference to the following specific examples, which are not meant to limit the invention, but rather to further illustrate it.

Through computer modeling, it has been found that the removal of sulfuric acid from the chlorine dioxide generator effluent can lead to a lowering of sulfur concentration in the chemical recovery cycle. Unexpectedly, combining the electrostatic precipitator (ESP) catch purge with chlorine dioxide generator effluent and removing both the acid and the chloride in an acid separation step can maintain the sulfur concentration in the Kraft pulp process without increasing the chloride ion concentration.

An example application of an embodiment of the present invention will be described using a 1000 air dried metric tonnes per day (ADMTPD) Kraft Pulp mill producing 32 tonnes per day (TPD) of chlorine dioxide for use in bleaching. A typical precipitator catch composition is 30% Na, 44% $SO_4$, 10% $CO_3$, 12% Cl, and 4% K. The net other losses from the Kraft pulp mill chemical recovery cycle are 21.4 kg/ton Na, 5 kg/ton S.

Figure 5:
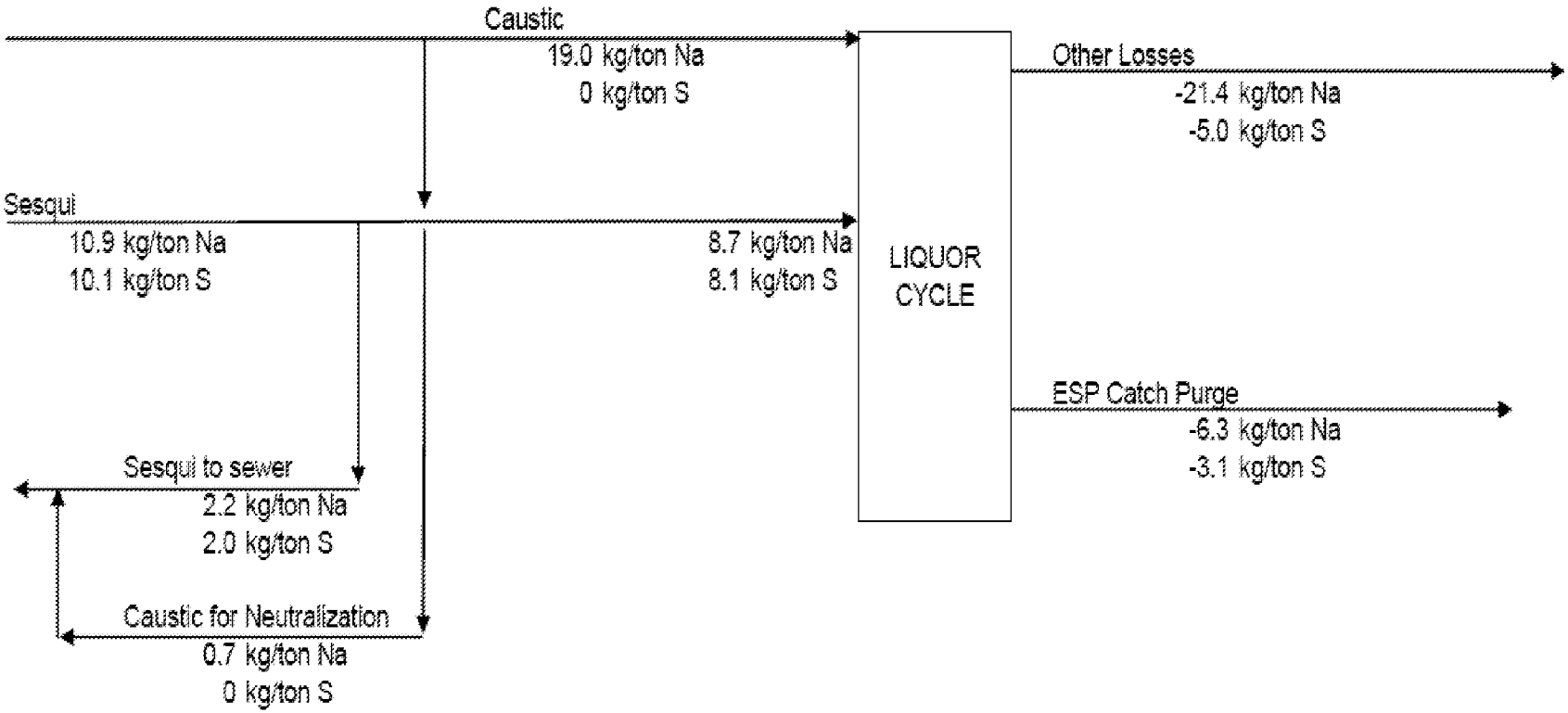
FIG. 5 is an example chemical balance diagram for a 1000 ADMTPD Kraft pulp mill.

The typical chemical balance for this mill is described below and shown in FIG. 5: Base Case.

- 20 TPD of precipitator catch is sewered for chloride control, containing 6.3 kg/ton of sodium and 3.1 kg/ton of sulfur.
- 80% of the chlorine dioxide generator effluent is fed to the chemical recovery cycle to make up for the sulfur losses.
- The chlorine dioxide generator effluent fed to the chemical recovery cycle contains 8.7 kg/ton of sodium.
- 19 kg/ton of sodium is required in addition to the sodium carried with the generator effluent. In this example, the sodium will be replaced as sodium hydroxide (NaOH).
- 2.2 kg/ton of sodium is required to neutralize the sewered chlorine dioxide generator effluent.

Figure 6:
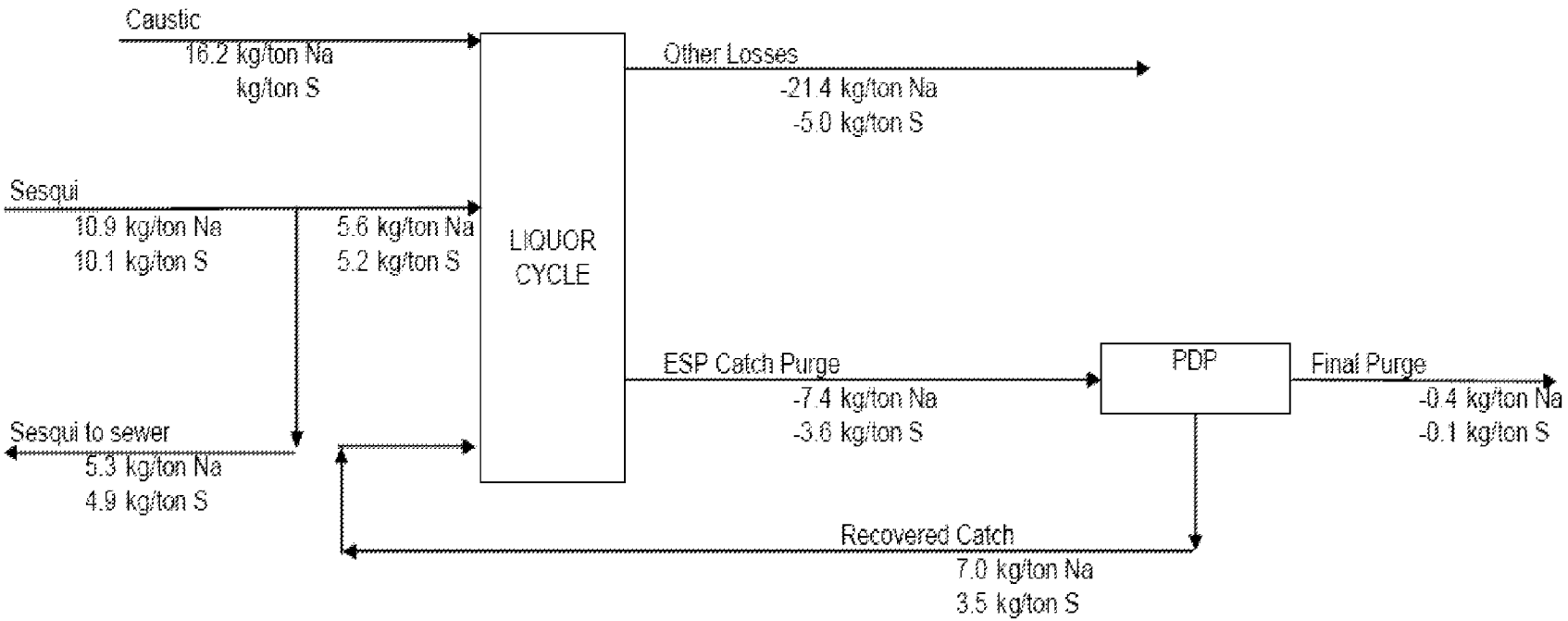
FIG. 6 is an example chemical balance diagram for a 1000 ADMTPD Kraft pulp mill in which chloride removal is performed by treating the ESP catch.

Chloride removal is typically performed by treating the ESP catch (for example, by ion exchange, leaching or crystallization), resulting in the chemical balance described below and shown in FIG. 6: Chloride Removal.

- Because the chloride removal is less than 100%, more ESP catch is sent to treatment than in the typical chemical balance.
- The recovered ESP catch contains 7.0 kg/ton of sodium and 3.5 kg/ton of sulfur.
- The additional sulfur in the ESP catch means that only 51% of the chlorine dioxide generator effluent is sent to recovery for sulfur makeup.
- The sodium fed to recovery as caustic soda is reduced to 16.2 kg/ton, but the sodium required to neutralize the sewered chlorine dioxide generator effluent is increased to 3.1 kg/ton.

Figure 7:
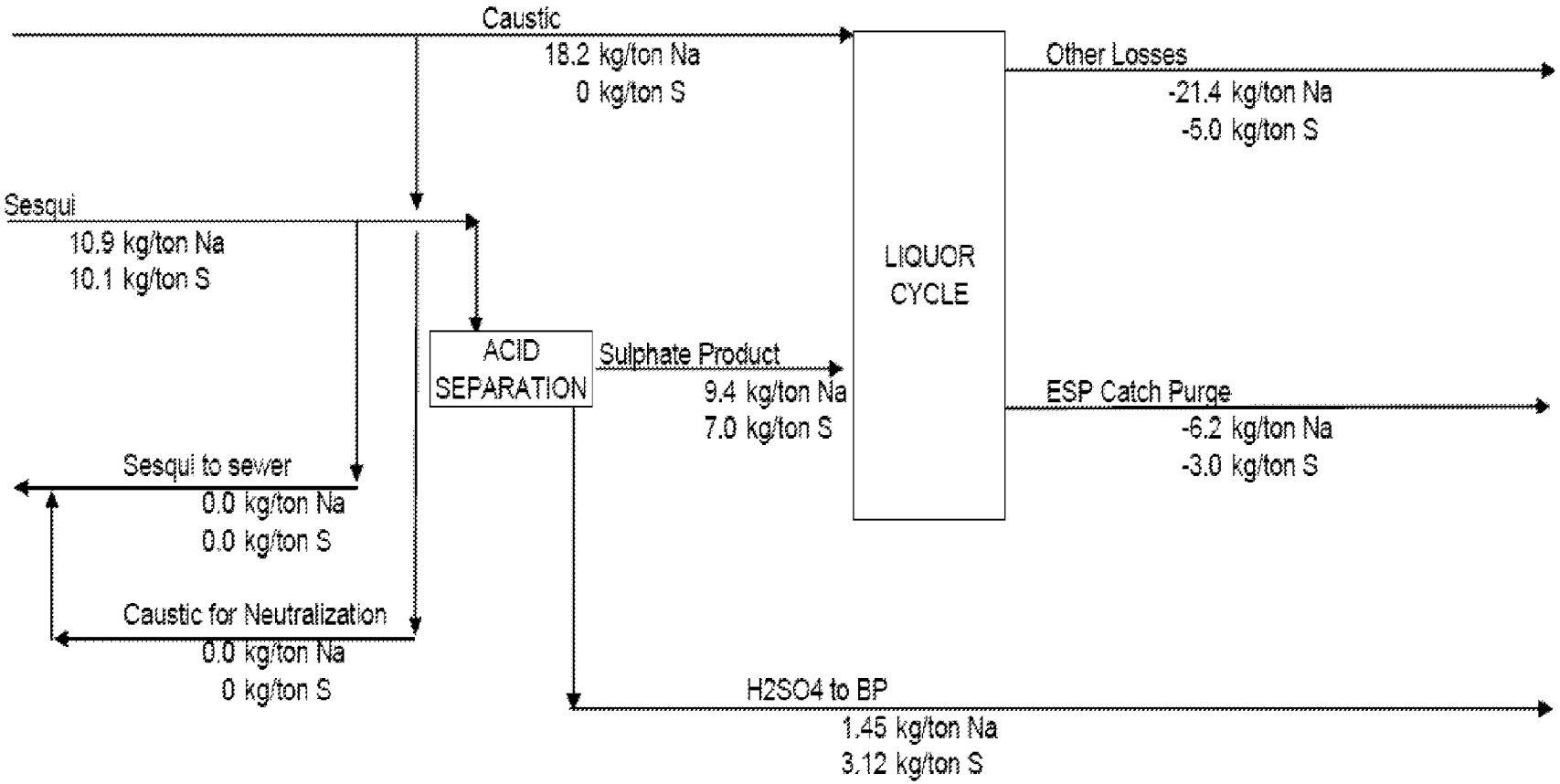
FIG. 7 is an example chemical balance diagram for a 1000 ADMTPD Kraft pulp mill in which sulfuric acid is removed from the chlorine dioxide generator effluent.

Installing a system to remove the acid from the chlorine dioxide generator effluent, for example by using a suitable fixed-resin bed acid retardation unit as described in U.S. Pat. No. 5,792,441, results in the chemical balance described below and shown in FIG. 7: Acid Separation.

- The treated chlorine dioxide generator effluent (now in the form of neutral saltcake $Na_2SO_4$), contributes 9.4 kg/ton of sodium and 7 kg/ton of sulfur to the chemical recovery cycle.
- 3.12 kg/ton of sulfur is exported to bleach plant as acid.
- The sodium makeup requirements to the chemical recovery cycle are reduced to 18.2 kg/ton.
- No chlorine dioxide generator effluent is sewered, and therefore no sodium is required for neutralization.

There is a net sulfur shortfall to the chemical recovery cycle of 1.1 kg/ton, which would have to be made up with purchased chemical.

Figure 8:
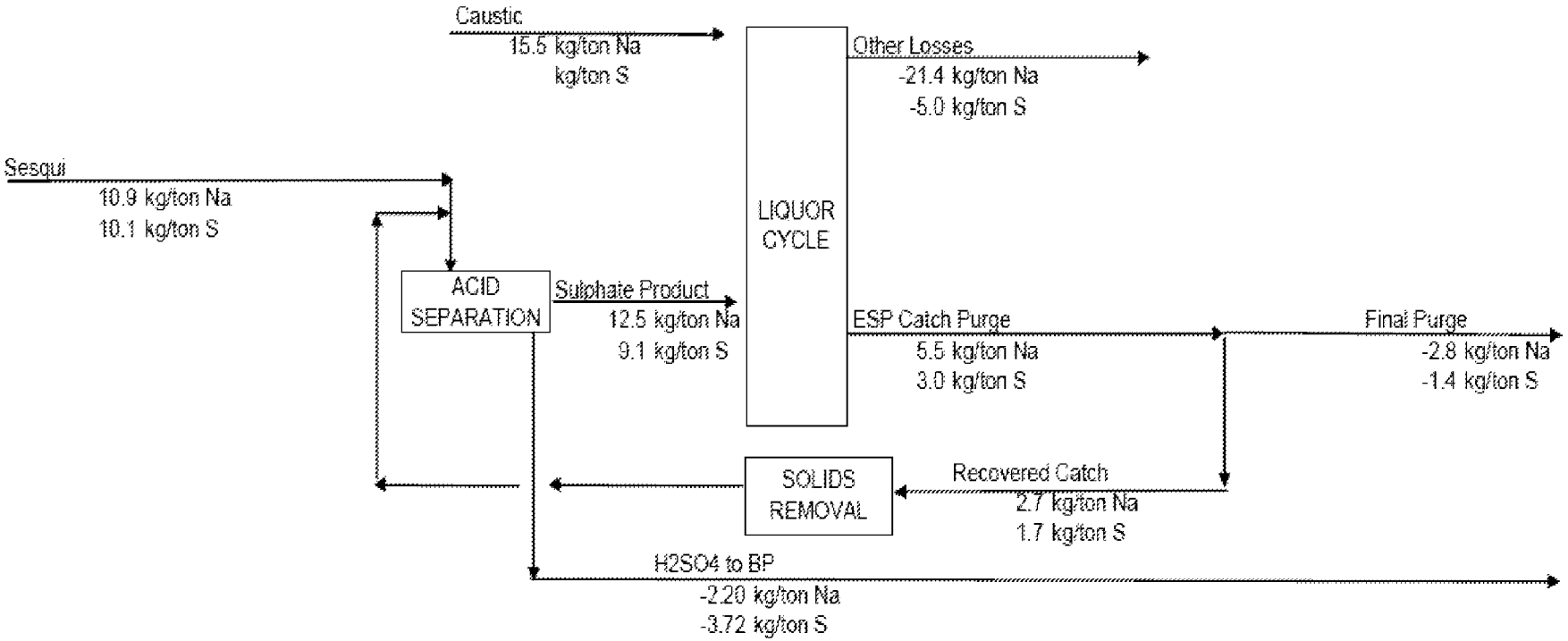
FIG. 8 is an example chemical balance diagram for a 1000 ADMTPD Kraft pulp mill in which dissolved and treated ESP catch is added to the chlorine dioxide generator effluent and acid is removed from the resulting solution.

The addition of dissolved, treated ESP catch to the chlorine dioxide generator effluent results in the chemical balance described below and shown in FIG. 8: Acid Separation with the addition of ESP catch.

The dissolved, treated ESP catch sent to the generator waste acid contains 2.7 kg/ton of sodium and 1.7 kg/ton of sulfur.

In the acid separation step, chloride and acid are removed from the combined ESP catch-chlorine dioxide generator effluent.

The net purge of ESP catch is 2.8 kg/ton of sodium, 1.4 kg/ton of sulfur.

The sodium makeup requirements to the chemical recovery cycle are reduced to 15.5 kg/ton.

3.72 kg/ton of sulfur is exported to the bleach plant as acid.

While a number of exemplary aspects and embodiments have been discussed above, those of skill in the art will recognize certain modifications, permutations, additions and sub-combinations thereof. Mutually non-exclusive features of the embodiments described above can all be incorporated or combined together in any suitable combinations in other embodiments that are within the scope of the present invention. It is therefore intended that any claims hereafter introduced are interpreted to include all such modifications, permutations, additions and sub-combinations as are within their true spirit and scope.

What is claimed is:

1. A method for maintaining sulfur concentration in a Kraft pulping process, the method comprising the steps of:

collecting recovery boiler ash from a recovery boiler of a Kraft pulp mill;

dissolving a portion of the recovery boiler ash in acid;

treating the dissolved recovery boiler ash-acid solution to remove solids;

subjecting the treated solution to an acid separation step to provide a sodium sulfate enriched phase and an acid phase; and using at least a portion of the sodium sulfate enriched phase to maintain sulfur concentration in the Kraft pulping process.

2. A method according to claim 1, wherein the step of collecting recovery boiler ash comprises using an electrostatic precipitator to produce an electrostatic precipitator catch purge.

3. A method according to claim 2, wherein the step of subjecting the solution to an acid separation step comprises separating chloride ions from the solution into the acid phase.

4. A method according to claim 2, wherein the acid comprises effluent from a chlorine dioxide generator.

5. A method according to claim 2, wherein the acid comprises sodium sesquisulfate.

6. A method according to claim 2, wherein the acid separation system comprises a fixed-resin bed acid retardation unit.

7. A method according to claim 6, wherein the acid separation system comprises a fixed-resin bed retardation unit comprising a particulate quaternary ammonium resin.

8. A method according to claim 2, wherein the concentration of sodium sulphate in the solution is maintained below about 40 g per 100 g of water.

9. A method according to claim 2, further comprising the step of providing the acid phase to the chlorine dioxide generator.

10. A method for maintaining sulfur concentration in a Kraft pulping process, the method comprising the steps of:

collecting recovery boiler ash from a recovery boiler of a Kraft pulp mill;

dissolving a portion of the recovery boiler ash;

treating the dissolved recovery boiler ash to remove solids;

combining the treated dissolved recovery boiler ash with acid to provide a solution;

maintaining the solution in a fully dissolved state;

subjecting the solution to an acid separation step to provide a sodium sulfate enriched phase and an acid phase; and using at least a portion of the sodium sulfate enriched phase to maintain sulfur concentration in the Kraft pulping process.

11. A method according to claim 10, wherein the step of dissolving a portion of the recovery boiler ash comprises dissolving the portion of the recovery boiler ash in water.

* * * * *